United States Patent [19]

Meador et al.

[11] Patent Number: 5,031,764

[45] Date of Patent: Jul. 16, 1991

[54] APPARATUS FOR DESIGNING PERSONALIZED PERFUME

[76] Inventors: Clifford A. Meador, 1070 Mission Lyn Rd., Santa Barbara, Calif. 93105; David S. Noble, 1422 "D" Banner Ave., Summerland, Calif. 93067

[21] Appl. No.: 394,529

[22] Filed: Aug. 16, 1989

[51] Int. Cl.[5] ..... A45D 34/00; B65D 85/72; B65D 73/00

[52] U.S. Cl. ..... 206/232; 206/459; 206/456; 206/484; 206/820; 206/823; 206/549

[58] Field of Search ..... 206/459, 449, 456, 484, 206/820, 823, 824, 831, 549, 568, 569, 542, 545, 223, 232; 73/864.72, 864.91

[56] References Cited

U.S. PATENT DOCUMENTS

| | | | |
|---|---|---|---|
| 1,546,302 | 7/1925 | Mehigan | 206/232 X |
| 2,239,145 | 4/1941 | Doner | 206/232 X |
| 2,822,082 | 2/1958 | Breckwoldt et al. | 206/232 X |
| 3,980,203 | 9/1976 | Dearling | 221/96 |
| 4,277,024 | 7/1981 | Spector | 206/466 X |
| 4,369,882 | 1/1983 | Schluger | 206/459 X |
| 4,496,051 | 1/1985 | Ortner | 206/459 |
| 4,611,611 | 9/1986 | Beal, Jr. | 132/320 |
| 4,817,860 | 4/1989 | Shapiro | 206/632 X |
| 4,848,378 | 7/1989 | Moir et al. | 132/319 |
| 4,884,719 | 12/1989 | Levine et al. | 221/25 |

FOREIGN PATENT DOCUMENTS

| | | | |
|---|---|---|---|
| 2534882 | 4/1984 | France | 206/459 |
| 68879 | 3/1988 | Japan | 206/823 |
| 8204091 | 5/1984 | Netherlands | 206/459 |
| 8703563 | 6/1987 | PCT Int'l Appl. | 206/459 |

*Primary Examiner*—Tom Noland

*Attorney, Agent, or Firm*—Fleit, Jacobson, Cohn, Price, Holman & Stern

[57] ABSTRACT

A plurality of tapered sample strips are secured at one end to a border strip to faciliate the performance of perfumery by a relative novice in the field. The tapered sample strips include the fragrance of a note, which is an essential oil, used in the perfume industry to manufacture perfumes. The series of tapered sample strips secured to the border strip are prepared for sampling by first separating two sets of border strips with their associated tapered sample strips from a die-cut sample sheet of heavy paper. The identifying indicia and color for each fragrance is clearly indicated. A tiered sample rack or case, including a plurality of capped bottles, corresponding to the number of tapered sample strips on each border strip, contains different notes or essential oils which correspond in order to the marked indicia on the tapered sample strips. Each tier of bottles corresponds to a separate border strip and its associated tapered sample strips.

14 Claims, 3 Drawing Sheets

APPARATUS FOR DESIGNING PERSONALIZED PERFUME

FIELD OF THE INVENTION

This invention relates to a method and apparatus for producing custom perfumes based on an individual's taste. By the invention, an individual may select a combination of fragrances which are desired to be incorporated into a personal perfume.

BACKGROUND OF THE INVENTION

Prior to the creation of the present invention, the science of perfumery was a lengthy and involved process for selecting a desired fragrance for a perfume. Typically, unlabelled scented sticks were sampled and a judgment made as to how to vary the scents to achieve a desired scent. The involvement of the process made the selection of a perfume unavailable to the average person.

SUMMARY OF THE INVENTION

By the present invention, the disadvantages of the prior art have been overcome. An individual is now capable of designing a custom fragrance in a short time span, enabling the average person to create his or her own perfume or cologne.

By the present invention, a plurality of tapered sample strips are secured at one end to a border strip to facilitate the performance of perfumery by a relative novice in the field. The tapered sample strips include the fragrance of a note, which is an essential oil, used in the perfume industry to manufacture perfumes.

The tapered configuration of the sample strips allows for ease of handling during the perfume creation phase when the customer is sampling different combinations of the various fragrances. The broader base of the sample strip allows the customer to hold the sample strips as he/she would handle playing cards. Thusly arraying them in a fanlike fashion in one hand, allowing for the evaluation of their combined fragrance by fanning them in a sideways fashion under their nose.

The tapered sample strips secured to the border strip are classified into family of notes by color of the tapered sample strips, which are grouped together by the same family having the same color strip. An example of the different fragrance families are fruit, floral, fantasy, herbal, oriental/spice, fougere, chypre/wood, and leather. It is therefore easy to distinguish between the different families of notes. The individual tapered sample strips are further identified by indicia of name and number and arranged by family in an order that is optimum for sampling. The sample strips are arranged in order such that they are sampled from lightest to heaviest in fragrance. The lighter fragrances evaporate quickly, while the heavier fragrances evaporate more slowly. It is vital to the perfuming process to smell less distinctive, lighter fragrances first and the more distinctive, heavier fragrances last. This allows the olfactory glands to obtain a true scent of each fragrance.

The series of tapered sample strips secured to the border strip are prepared for sampling by first separating two sets of border strips with their associated tapered sample strips from a die-cut sample sheet of heavy paper. The identifying indicia and color for each fragrance is clearly indicated. Typically, four border strips, each having eleven tapered sample strips are formed from two sample sheets. However, the number of tapered sample strips may be increased or decreased according to the number of fragrances to be used in the sampling process.

A tiered sample rack or case, including a plurality of capped bottles, corresponding to the number of tapered sample strips on each border strip, contains different notes or essential oils which correspond in order to the marked indicia on the tapered sample strips. Each tier of bottles corresponds to a separate border strip and its associated tapered sample strips.

The caps are removed from the bottles in a first row located on a tier of the sample case. The border strip with the corresponding tapered sample strips are lowered into the bottle so that the ends of the tapered sample strips just touch the essential oil in each bottle. When the tapered sample strips have been dipped in the corresponding essential oils, the border strip is temporarily stored in a holding rack. This process is repeated for each of the three other border strips and their associated tapered sample strips for the remaining three tiers and associated three rows of capped bottles containing essential oils.

The sample strips are detached from the border and stored in the holding rack until a customer is given each of the now fragranced tapered sample strips. Alternately, the tapered sample strips may include a peel-off strip for release of a microencapsulated fragrance.

Fragrances are microencapsulated in a special polymer. The microencapsulated fragrance is then applied by a spray or other means to a backing sheet with an adhesive vehicle. A sheet of paper covers the microencapsulated fragrance. The adhesive vehicle containing the microencapsulated fragrance is then allowed to dry. When the paper, such as a peel strip, is separated from the backing sheet, the microcapsules open, thus freeing the fragrance into the air.

After the customer has sampled each of the fragrances of the tapered sample strips by passing the strip by their nose, the customer is now able to create an individualized perfume. The customer is then given a set of the four border strips and associated tapered sample strips and the less desirable fragrances of labelled tapered sample strips are removed from the border strip. Then, only the tapered sample strips containing desirable fragrances are dipped into the corresponding tier of the sample case with the corresponding bottles of essential oils. Since the less desirable sample strips have been removed, only the desired essential oils will be transferred to the remaining tapered sample strips.

The customer, then, only dealing with the most desirable fragrances, sniffs and selects the combination of tapered sample strips having the desired combined fragrance for their personalized perfume. The selected tapered sample strips are secured together so as to clearly identify the desired fragrances which should be combined to produce their own custom perfume. Based upon the selected fragrances, a customized perfume is then made based on an individual's personal taste.

It is therefore an object of the present invention to provide a method and apparatus for sampling fragrances of essential oils.

It is another object of the present invention to sample the fragrances of essential oils by dipping a plurality of spaced tapered sample strips secured to a border strip with a free end of the tapered sample strip being immersed in bottles of essential oils corresponding to indicia and color of the tapered sample strips.

It is another object of the present invention to sample the fragrances of different essential oils and select certain fragrances which are provided on another border strip having tapered sample strips corresponding only to the selected preferred fragrances so as to sample a reduced number of fragrances of essential oils.

It is still yet another object of the present invention to sample the fragrances of different essential oils and select certain fragrances which are provided on another border strip having tapered sample strips corresponding onlY to the selected preferred fragrances so as to sample a reduced number of fragrances of essential oils and then select only the desired fragrances to be combined in a customized perfume.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
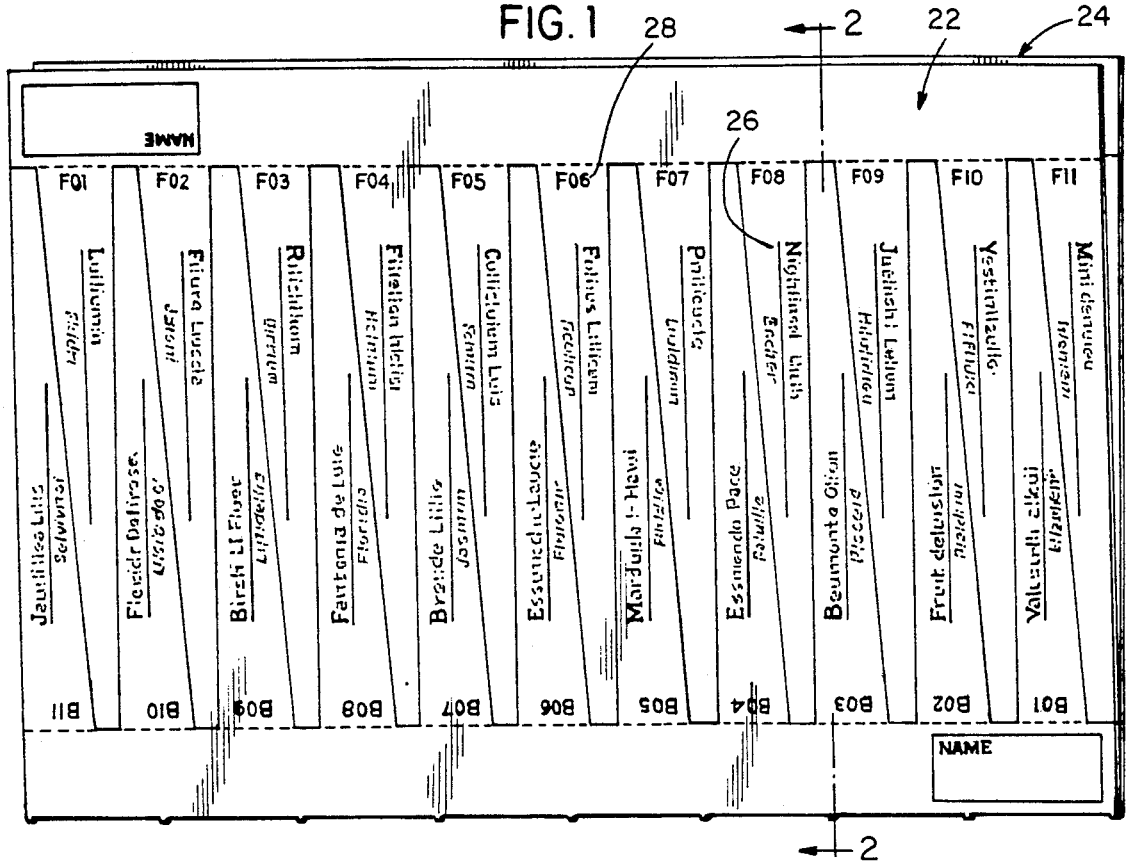
FIG. 1 is a side elevation view of two die-cut sample sheets having preprinted tapered sample strips.
Figure 2:
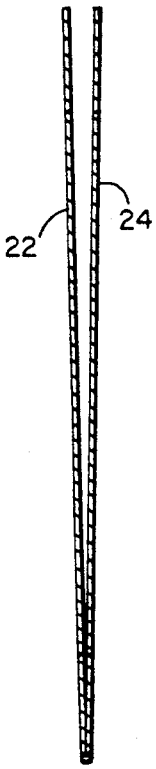
FIG. 2 is a sectional view taken along line 2—2 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a fragrance sampling card embodying the teachings of the subject invention is generally designated as 20. With reference to its orientation in FIG. 1, the sampling reference card is shown in its die-punched condition prior to separation from two sample sheets 22 and 24. Each sample sheet is printed to include the identifying indicia of name 26 and number 28.

Each sheet 22 and 24 is separated from each other and then each sheet is separated to include two sample cards 20 which include a plurality of tapered sample strips 30 connected to a border strip 32 by perforated score lines 34. The border strip 32 includes a box 36, with indicia 38, for prompting entry of the name of a customer.

Figure 3:
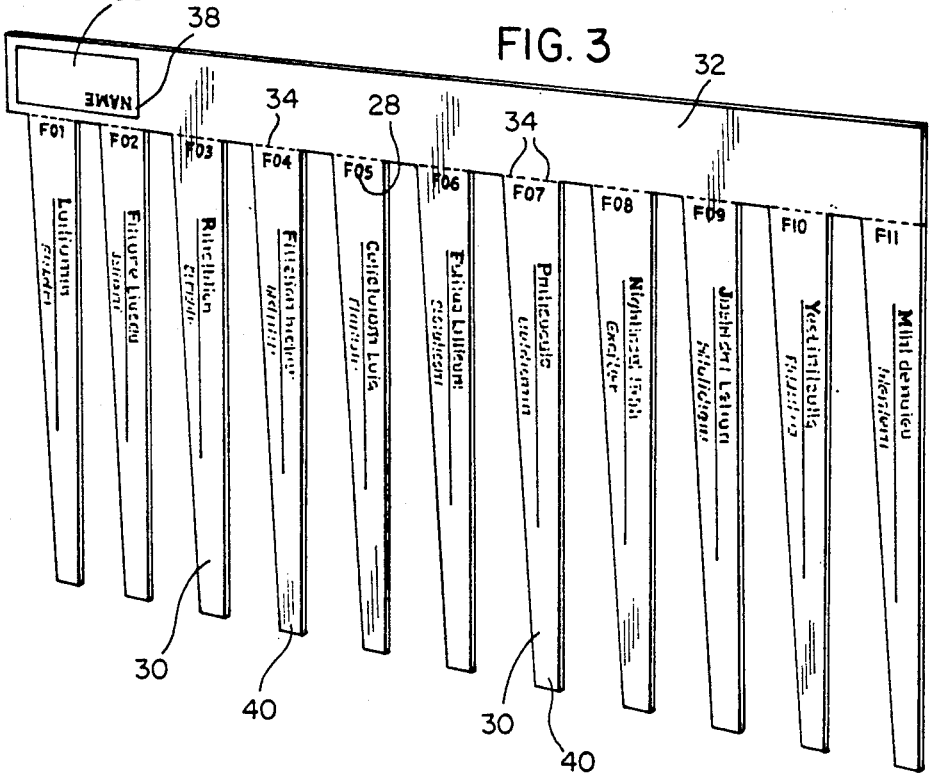
FIG. 3 is a perspective view of a single border strip with associated tapered sample strips.

In the sample card 20, shown in FIG. 3, eleven tapered sample strips are associated with border 32. The number of tapered sample strips may be greater or less so as to correspond to a number of bottles of essential oils to which the free ends 40 of the strips 30 are to be dipped. In FIG. 3, for example, seven of the sample strips including the identification FO1 through F07 may be of the same color whereas strips FO8 and FO9 may be of a different color and strips F10 and F11 would be of a third color. The use of different color strips identifies groups of families of fragrances and to group the fragrances of a particular family together.

Figure 6:
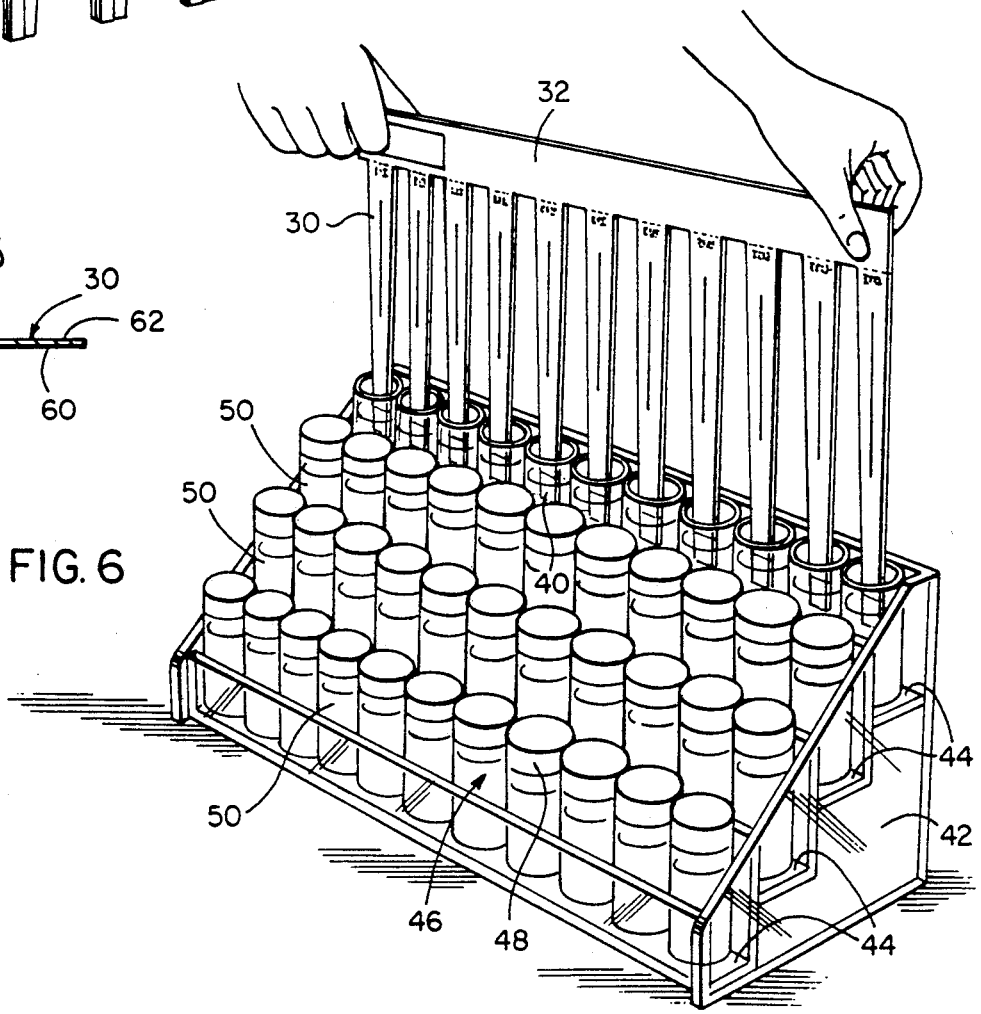
FIG. 6 illustrates the dipping of a border strip and its associated tapered sample strips into a row of bottles containing essential oils with the bottles being located on a tier of a sample case.

In FIG. 6, a sample case 42 made of transparent plastic, includes four steps or tiers 44 for supporting a row of bottles 46, having caps 48, for securing essential oils 50, with a different essential oil in each bottle. The number of bottles 46 on each tier 44 of transparent case 42 corresponds to the number of tapered sample strips connected to a border strip.

Initially, a sample sheet 20 is grabbed by the border strip 32 and free ends 40 of the tapered sample strips are dipped into the essential oils contained in the bottles which correspond to the labeling indicia of the tapered sample strip. The strips are tapered so that the free end of the strips will fit within the opening of the bottle 50 and the wider opposite end is easily held in the hand of a customer in a fan-like array.

Figure 7:
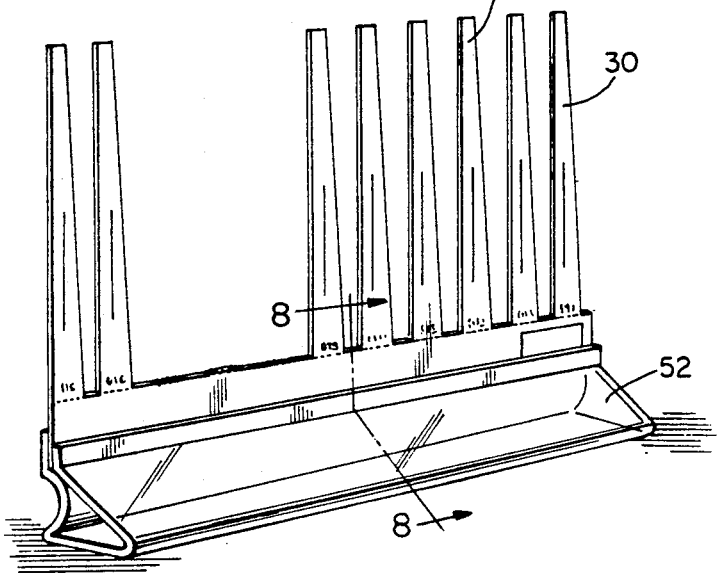
FIG. 7 illustrates a holder for a border strip having selected tapered sample strips.
Figure 8:
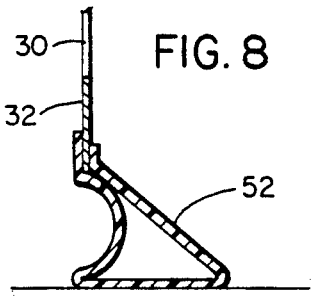
FIG. 8 is a sectional view taken through line 8—8 of FIG. 7.

The sample card is then inverted from the position shown in FIG. 6 and placed within a rack 52 in a position similar to that shown for the sample sheet shown in FIG. 7. However, it is noted that the sample sheet shown in FIG. 7 is missing three of the tapered sample strips, which will be explained later. After the essential oils have set in the free end of the strips of the sample card, the sample card is ready for sampling by the customer.

Figure 4:
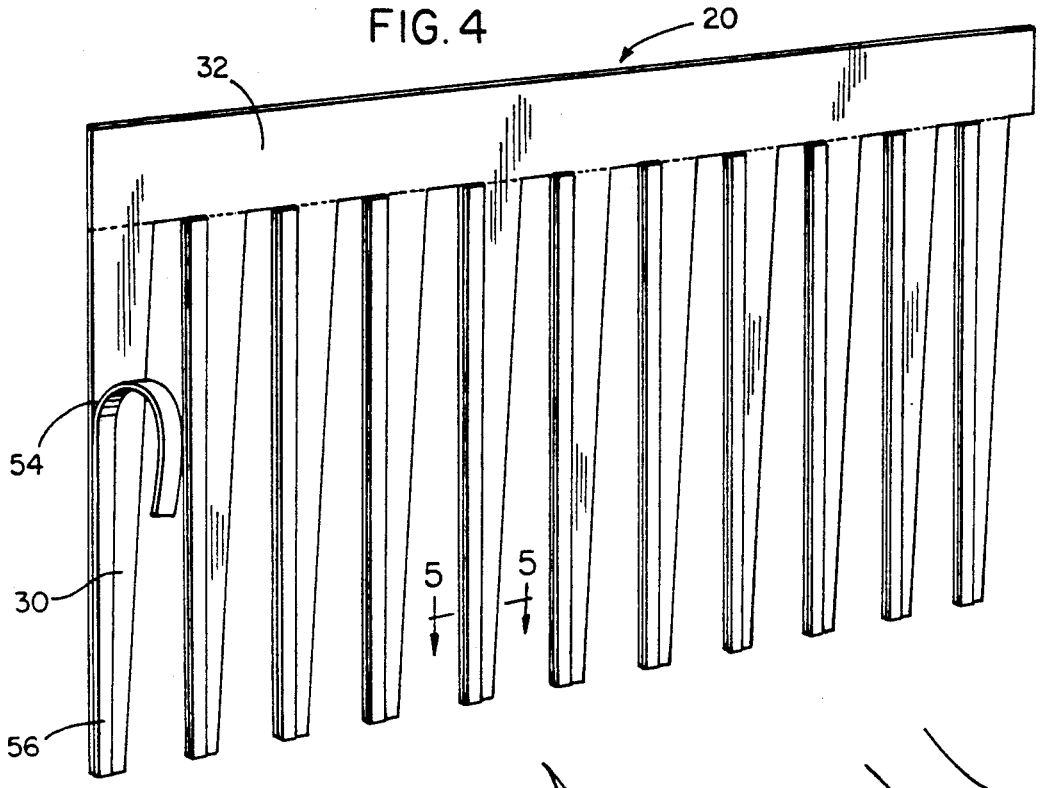
FIG. 4 is a perspective view of an alternate embodiment of tapered sample strips secured to a border strip.

As an alternate method of transferring a different fragrance to each of the tapered sample strips, the sample sheet 20 shown in FIG. 4 may be used, which is identical on its front face to the sample sheet shown in FIG. 3. On the rear face which is shown in FIG. 4, a strip of a microencapsulated fragrance is located along an edge 54 of the tapered sample strip 30. The edge 54 is covered by a removable peel strip 56 which upon removal, releases a fragrance at an area along the edge 54 of the strip 30 by breaking of the capsules containing the fragrance. As shown in more detail in FIG. 5, a scented area 58 is located sandwiched between the rear surface 60 of the sample strip 30, opposite the surface 62, which includes the printed indicia and color for a particular fragrance and its family, and the peel strip 56.

Figure 5:
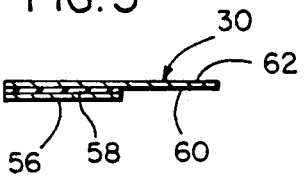
FIG. 5 is a sectional view taken along line 5—5 of FIG. 4.

By the method of FIG. 6 or that disclosed in FIGS. 4 and 5, the result is a border strip with a plurality of tapered sample strips having a different fragrance on each strip as identified by labelling indicia including color, title and reference number. After the scenting of the tapered sample strips has been accomplished the scent card 20 is ready for sampling by a customer and ultimate selection of a personalized perfume.

The four sample cards produced from the two sample sheets 22 and 24 are each dipped in a different row of essential oils contained in the sample case 42 or include a microencapsulated fragrance so as to provide, in this example, 44 different fragrances of essential oils which are identified by number, title and family.

To sample the different fragrances, the tapered sample strips 30 are removed from the border strip 32 along the perforation lines 34. The individual sample strips are either held within rack 52 or passed directly to a customer to allow the customer to sample an individual fragrance. In the dipped sample strip the fragrance is sniffed whereas in the microencapsulated fragrance strips, the peel strip is removed to release a fragrance and then sniffed.

The customer notes the most desired fragrances by fragrance name or identifying number. If a particular fragrance is enjoyed, other fragrances of the same family are easily identified by the color coding of fragrances belonging to the same family. After each of the individual tapered sample strips have been sampled, each customer is given a complete sample card 20. The customer then removes the tapered sample strips of the fragrances they have identified as not being of particular interest to them. Only the tapered sample strips identifying fragrances they would consider ultimately to use in their personalized perfume then remain on the border strips of the sample cards. The name of the customer may be inserted into the box 36 for proper identification.

Following the procedure previously explained for the dipping of the sample cards, the sample cards, with the tapered sample strips with the less desirous fragrances having been removed by the customer, is then dipped into the corresponding row of essential oil bottles in the sample case. The sample card is then placed into the rack 52 as shown in FIG. 7, which also shows a typical sample card with some of the tapered sample strips having been removed for saturation of the tapered sample strips by the essential oils.

When the customer is ready to sample the dipped sample strips, the sample card with the selected sample strips is returned to the customer in the rack or first removed from the rack and then returned to the customer. The customer then resamples the selected fragrances by sniffing. The selected sample strips may be removed from the sample sheet by ripping along the perforation lines 34 and holding several sample strips together to obtain a combined potential fragrance for a personalized perfume.

Figure 9:
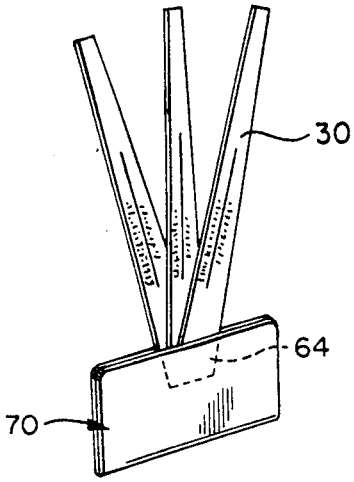
FIG. 9 illustrates a securing card for sealing selected tapered sample strips together.
Figure 10:
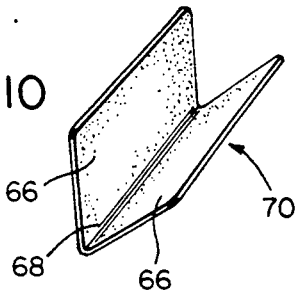
FIG. 10 illustrates the secured card in an open condition.
Figure 12:
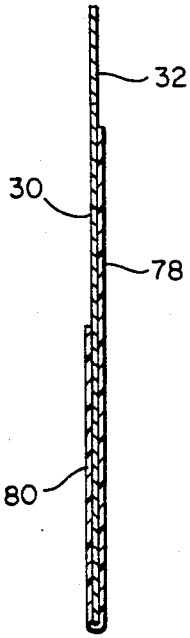
FIG. 12 is a sectional view taken along 12—12 of FIG. 11.
Figure 11:
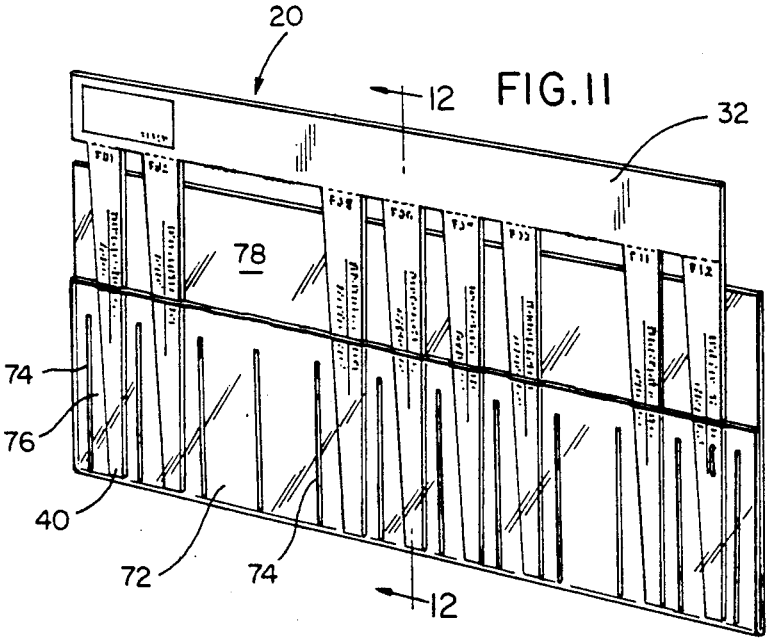
FIG. 11 illustrates a chambered shipping holder with inserted tapered sample strips.

After mixing and matching the most desirous fragrances, a decision is ultimately made as to a desired personalized perfume for a customer. The selected finalist strips are placed with their perforated strip ends 64 between the sides 66 of a prepasted or adhesive layer and folded about fold line 68 to secure the desired sample strips 30 in a case 70, as shown in FIG. 9, to hold the finally selected sample strips 30. Based upon the selected sample strips, a personalized perfume is mixed for a particular customer.

Sampling of the different fragrances of the essential oils may also be accomplished by shipping the sample cards 20 within a transparent shipping case 72, which includes separation lines 74, so as to form individualized chambers 76 to contain a fragrance without mixing with adjacent fragrances, between a rear sheet 78 and a front sheet 80, so as to seal the fragrance located at a free end 40 of a tapered sample strip 30.

Having described the invention, many modifications thereto will become apparent to those skilled in the art to which it pertains without deviation from the spirit of the invention as defined by the scope of the appended claims.

We claim:

1. A sample sheet kit for sampling different fragrances of essential oils, said sample sheet comprising a plurality of elongated sample strips having two ends, indicia means located on said sample strips for identifying a fragrance of a particular essential oil with a different fragrance being identified on each of said elongated sample strips, one end of said plurality of elongated sample strips being scented with a fragrance corresponding to a fragrance identified by said indicia means, a case formed by a front sheet and a rear sheet secured together, said one end of said plurality of elongated sample strips being sealed between said front sheet and said rear sheet to avoid mixing of a particular fragrance of one elongated sample strip with an adjacent elongated sample strip, the other end of said elongated sample strips being holdable in a hand of a customer in a fan-like array so that upon sampling of said sample strips, a determination is made of a combination of desired fragrances held in the hand of the customer as represented by at least two sample strips which are combined according to the essential oils identified by the indicia means to produce a customized perfume.

2. A sample sheet as claimed in claim 1, wherein said sample strips are tapered inwardly from a border strip to said one end.

3. A sample sheet as claimed in claim 1, wherein said indicia means identifies a family common to at least two of said sample strips.

4. A sample sheet as claimed in claim 1, wherein said sample strips are spaced from each other along a length of a border strip.

5. A sample sheet as claimed in claim 1, wherein said sample strips are removably secured to a border strip.

6. A kit for selecting fragrances for a personalized perfume, said kit comprising:

a plurality of sample sheets each including a border strip, a plurality of sample strips connected at one end to said border strip, and indicia means located on said sample strip for identifying a particular fragrance, a sample case, and container means located in said sample case for containing an essential oil, said container means being aligned in said case to correspond with a spacing of said sample strips so that a free end of said sample strips when dipped into said container means contacts an essential oil contained in said container means having a fragrance corresponding to the particular fragrance identified by said indicia means of said sample strip.

7. A kit for selecting fragrances as claimed in claim 6, wherein said sample case includes tiered shelves for supporting rows of said container means.

8. A kit for selecting fragrances as claimed in claim 6, wherein said sample strips are removably connected to said border strip by perforations.

9. A kit for selecting fragrances as claimed in claim 6, wherein said indicia means identifies a family common to at least two of said sample strips.

10. A kit for selecting fragrances as claimed in claim 9, wherein said sample strips are tapered inwardly from said border strip to said free end.

11. A system for sampling different fragrances of essential oils for selecting preferred fragrances for combination in a customized perfume, said system comprising:

a plurality of elongated sample strips having two ends, indicia means located on said sample strips for identifying a fragrance of a particular essential oil with a different fragrance being identified on each of said elongated sample strips, fragrance means located at one end of each of said elongated sample strips for storing a different fragrance on each sample strip corresponding to the particular fragrance identified by said indicia means, a case formed by a front sheet and a rear sheet sealed together, said plurality of elongated sample strips being sealed between said front sheet and said rear sheet to avoid mixing of a particular fragrance of one elongated sample strip with an adjacent elongated sample strip, the other end of said elongated sample strips being held in a hand of a customer in a fan-like array so that upon sampling of said sample strips, a determination is made of a combination of desired fragrance held in the hand of the customer as represented by at least two sample strips which are combined according to the essential oils identified by the indicia means to produce a customized perfume.

12. A system for sampling different fragrances as claimed in claim 11, wherein said fragrance means includes a microencapsulated fragrance released by removal of a peel strip.

13. A system for sampling different fragrances as claimed in claim 12, wherein said indicia means include a title of a particular fragrance.

14. A system for sampling different fragrances as claimed in claim 12, wherein said indicia means include a color representative of a particular family of fragrances.

* * * * *